United States Patent [19]

Lüscher

[11] Patent Number: 4,580,035

[45] Date of Patent: Apr. 1, 1986

[54] APPARATUS FOR HEATING FOOD-WARMER PLATES

[75] Inventor: Paul Lüscher, Tauffelen, Switzerland

[73] Assignee: Lükon, Fabrik für elektrothermische Apparate und elektrische Stabheizkorper, Berne, Switzerland

[21] Appl. No.: 630,110

[22] Filed: Jul. 12, 1984

[30] Foreign Application Priority Data

Jul. 13, 1983 [CH] Switzerland ..... 3834/83

[51] Int. Cl.[4] ..... H05B 1/02

[52] U.S. Cl. ..... 219/398; 219/395; 219/405; 219/385; 219/518

[58] Field of Search ..... 219/398, 395, 399, 405, 219/385, 386, 387, 521, 518

[56] References Cited

U.S. PATENT DOCUMENTS

| | | | |
|---|---|---|---|
| 1,940,172 | 12/1933 | Hybinette | 219/386 |
| 2,126,882 | 3/1964 | Hilfiker | 219/399 |
| 2,831,098 | 4/1958 | Lüscher | 219/385 |
| 2,834,868 | 5/1958 | Green et al. | 219/43 |
| 2,919,339 | 12/1959 | Hilliker | 219/386 |
| 3,965,969 | 6/1976 | Williamson | 219/387 |
| 4,019,022 | 4/1977 | Seider et al. | 219/386 |
| 4,156,456 | 5/1979 | Müller | 219/518 |
| 4,285,391 | 8/1981 | Bourner | 219/387 |

FOREIGN PATENT DOCUMENTS

| | | | |
|---|---|---|---|
| 1130565 | 5/1962 | Fed. Rep. of Germany . | |
| 1423691 | 11/1965 | France | 219/385 |
| 2286630 | 9/1975 | France . | |
| 2357221 | 6/1977 | France . | |

OTHER PUBLICATIONS

"The Sweetheart Serving System", Plastics Division, Maryland Cup Corp., 1974.

*Primary Examiner*—C. L. Albritton
*Assistant Examiner*—Teresa J. Walberg
*Attorney, Agent, or Firm*—Burns, Doane, Swecker & Mathis

[57] ABSTRACT

An apparatus for heating food-warmer plates includes a housing into which a plurality of the food-warmer plates may be slid through slots in a wall of the housing. An electrical heating element is disposed under each food-warmer plate inserted into the housing. The heating elements may be switched on and off individually. In this way it is possible to heat only that number of food-warmer plates which is actually needed.

10 Claims, 4 Drawing Figures

APPARATUS FOR HEATING FOOD-WARMER PLATES

BACKGROUND AND SUMMARY OF THE INVENTION

The invention relates to an apparatus for heating heat-accumulating food-warmer plates. The apparatus comprises a housing into which a plurality of food-warmer plates may be slid through separate slots in the housing wall. An electrical heating device is disposed in the housing.

An apparatus of this general type is known in the prior art, e.g., Swiss Pat. No. 323,543. In the known apparatus the electrical heating device is intended to heat the entire interior space of the housing to a final or predetermined temperature. The food-warmer plates in the housing are heated together, and they may be individually removed and returned as requirements of use dictate.

If only a few of the heated warmer plates are needed, the energy consumption of the known apparatus is relatively high, because it is always necessary to heat the entire housing and all the warmer plates present therein, including the plates not needed.

A different type of known apparatus for heating food-warmer plates avoids this drawback, in that each food-warmer plate has its own built-in electrical heating element, and the housing in which a plurality of such plates may be inserted does not comprise a heating device but merely has electrical terminals to which the food-warmer plates may be connected e.g., Fr. Pat. No. 2,286,630. However, plates containing electrical devices and connecting terminals for these devices, are not generally suitable, at least not for commercial use, e.g. in restaurants, because they cannot be properly cleaned in a simple fashion. In the cleaning process, special attention must be paid to the electrical devices and connecting contacts. There is always the hazard of damage to the electrical devices and/or contacts due to careless cleaning or washing, which may lead to short circuits or life-threatening unintentional grounding.

Thus it is the object of the present invention to provide an apparatus for warming plates, wherein the electrical heating device is disposed within the housing and the food-warmer plates do not contain any electrical parts so as to avoid the disadvantage of high energy consumption and to enable energy savings.

The object is achieved according to the invention in that the heating device is comprised of heating elements which may be switched on and off individually, such that each heating element is associated with one of the food-warmer plates in the housing, so as to heat that particular food-warmer plate.

In this way, each of the food-warmer plates of the present device can be heated separately. In each use situation, one can then select for heating only that number of plates which will actually be needed. It is no longer necessary to heat the entire set of plates when only two or three will be needed.

Preferably, each heating element may also be switched off by a thermostat switch controlled by a temperature sensor disposed so as to determine the temperature of the respective food-warmer plate, whereby the thermostat switch may switch off the heating element as soon as the warmer plate reaches a predetermined or final temperature. During the time the plate is being heated to the predetermined temperature, the temperature between the plate and the heating element may be higher than the final temperature, in order to enable rapid heating of the plate. In contrast, to the above-described known apparatus, the temperature maintained within the housing is identical to the final temperature of the plates, and the plates approach the predetermined or final temperature asymptotically.

BRIEF DESCRIPTION OF THE DRAWINGS

There follows a more detailed description of an exemplary embodiment of the invention, with reference to the drawings.

DETAILED DESCRIPTION OF THE PREFERRED EMBODIMENT

Figure 1:
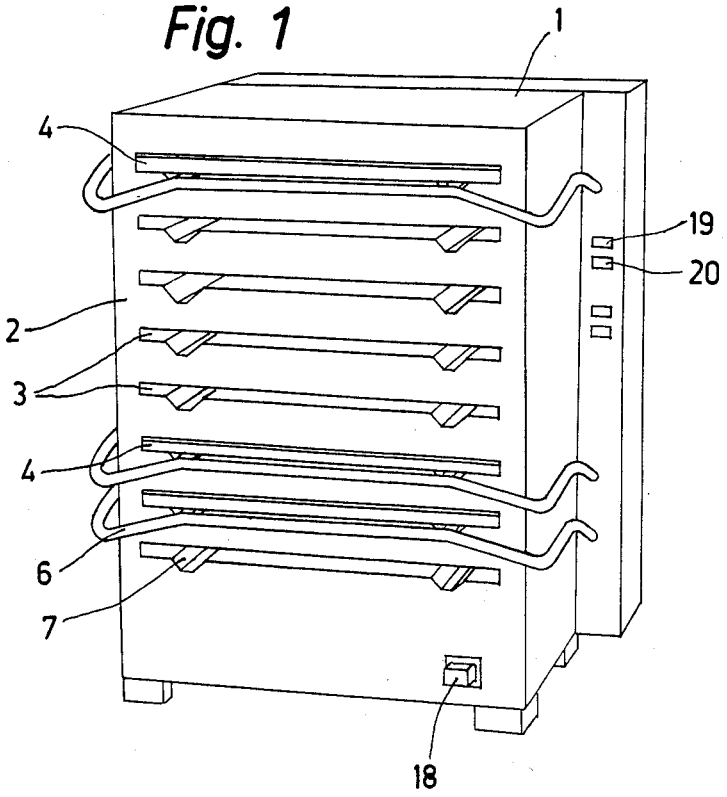
FIG. 1 is a perspective view of the apparatus for heating food-warm plates.

The apparatus shown in FIG. 1 includes a housing 1 with a front wall 2 in which a plurality of parallel horizontal slots 3 is provided through which heat-accumulating food-warmer plates 4 can be inserted into the interior of the housing. Each food-warmer plate 4 is attached to a curved element 6 by a supporting bar 5. The ends of the curved element serve as hand grips for carrying and manipulating the plates and as feet for standing the plates 4 on a flat surface. Guide channels 7 are provided for each plate along the interior of the slots 3 in the housing 1. The channels 7 hold the supporting bars 5.

An electrical heating element 8 is provided beneath each food-warmer plate 4 in the housing 1, between the guide channels 7 associated with each plate. Additionally, a heat shield in the form of a thermal reflective radiating panel 9 is provided beneath each heating element 8.

A rear end face of each food-warmer plate 4 comes into contact with a temperature sensing heat transfer rod 10 when the plate is fully inserted into the housing 1. Each plate 4 has an associated horizontal rod 10. Each rod 10 is axially slidably mounted in heat-resistant guide means 11 and 12 such that the rod is non-rotatable and is biased against the rear end face of the plate 4 by a spring 13. A thermostatic switch 14 with internal contact elements (schematically shown in FIG. 4) is attached to the end of rod 10 opposite the plate 4, the attachment being any appropriate heat conducting means. The thermostatic switch 14 has two connecting terminals, one of which is identified at 15, which are adapted to contact two corresponding contact strips or blades 17 provided on an insulating plate 16.

Figure 4:
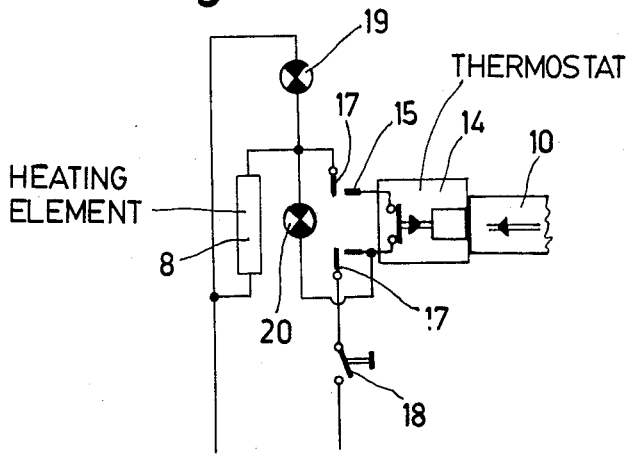
FIG. 4 is an electrical circuit diagram for one of the heating elements in the apparatus.

The electrical switching of the above-described heating elements 8 for the respective plates 4 is illustrated in FIG. 4. The circuit supplying the heating element 8 runs from a main switch 18 which is common to all the heating elements through a first contact strip or blade 17, the thermostatic switch 14, and a second contact strip or blade 17. A pilot light 19 is connected in parallel to the heating element 8, for each heat-accumulating plate 4. A second pilot light 20 is connected between a terminal of the heating element 8 and one of the terminals 15 of the thermostatic switch 14.

The mode of operation for the heat-accumulating food-warmer plates is as follows:

When a plate 4 has been pushed completely into the slot 3 of the housing 1, the contact terminals 15 of the thermostatic switch 14 are maintained in contact with the contact strips or blades 17 by means of the rod 10. The circuit through the contact strips or blades 17 and the thermostatic switch 14 to the heating element 8 is closed. The plate 4 is then heated up by the heating element 8 until a predetermined final temperature is reached. This final temperature of the plate 4 is transmitted over the heat-conducting rod 10 to the thermostatic switch 14 which opens its internal contact elements and shuts off the heating element 8.

During the heating, i.e. as long as the heating element 8 is switched on, the pilot light 19 is on. Pilot light 19 goes off when thermostatic switch 14 opens the circuit.

With the thermostatic switch 14 in the open state, pilot light 20 stays on as long as the connecting terminals 15 rest against the contact strips or blades 17 as a result of a plate 4 being in the inserted position. The pilot light 20 being on while pilot light 19 is off, signals the readiness of the heated, pushed-in plate 4 to be removed for use.

When the plate 4 is removed, the temperature sensing heat transfer rod 10 is pushed back by the spring 13, so that the connecting terminals 15 of the thermostatic switch 14 are separated from the contact strips or blades 17. The spring biased movement of the rod 10 breaks the circuit to the heating element 8 and to the pilot lights 19 and 20.

Figure 2:
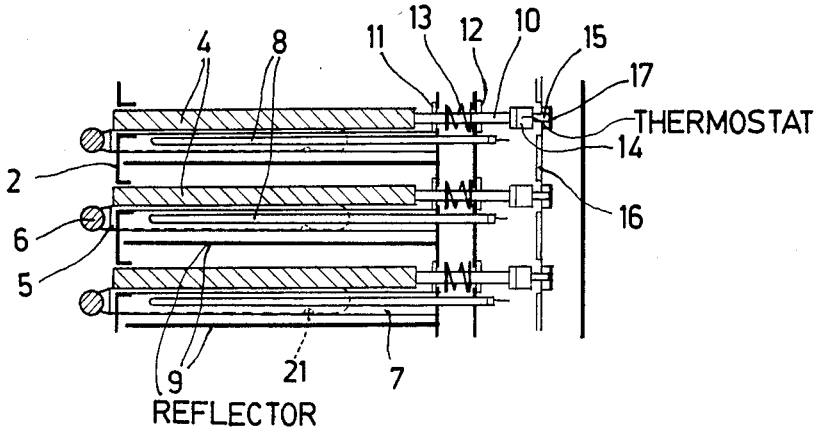
FIG. 2 is a schematic vertical cross section through part of the apparatus.
Figure 3:
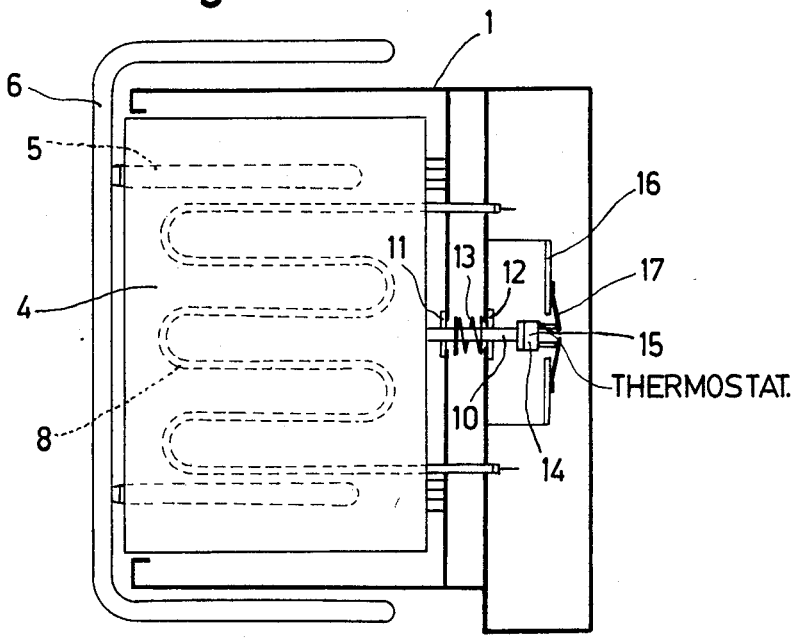
FIG. 3 is a schematic horizontal cross section through the apparatus.

In the apparatus described, one may heat only those food-warmer plates 4 which one desires to use. This may be accomplished by positioning the plates 4 which are not to be heated slightly backward, i.e., to the left in FIG. 2, about 1 cm. This causes the terminals 15 of the respective thermostatic switches 14 to become separated from the contact strips or blades 17, so that the heating elements 8 associated with the plates 4, which are not to be heated, are maintained in a disconnected state.

It is advantageous to provide locking or catching means for the plates 4 when in their fully inserted position. Such means are shown in the form of detents 21 (FIG. 2) stamped into the guide channels 7, so that when the plate 4 is in a fully inserted deposition, the detents engage corresponding recesses in the supporting bars 5 of the plate.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. An apparatus for heating heat-accumulating food-warmer plates, comprising a housing into which a plurality of said food-warmer plates may be received through a plurality of separate slots in a wall of the housing, a plurality of electrical heating elements each arranged in said housing for heating a respective one of said food-warmer plates received into said housing, a plurality of first switches each arranged in said housing for individually switching on and off a respective one of said heating elements, and a plurality of thermostatic second switches each arranged in said housing for individually disconnecting a respective one of said heating elements at a predetermined temperature, each of said thermostatic switches being separate from the respective heating element and being controlled by a respective temperature sensor and arranged in said housing for engaging said respective food-warmer plate received into the housing and for sensing the temperature of the food-warmer plate.

2. An apparatus according to claim 1; wherein each of the plurality of heating elements in the housing is provided beneath the food-warmer plate associated with said heating element, and a thermal reflective shield is provided beneath each said heating element.

3. An apparatus according to claim 2; wherein each of said plurality of first switches is arranged to be actuated by the respective food-warmer plate when said plate is fully inserted in said slot.

4. An apparatus according to claim 2; wherein a first pilot lamp is connected with each said heating element, said lamp is lit when the heating element is switched on.

5. An apparatus according to claim 4; wherein a second pilot lamp is associated with each said heating element, said second lamp is lit when both the respective first switch is closed and the respective thermostatic switch is open.

6. An apparatus according to claim 1; wherein a first pilot lamp is connected with each said heating element, said lamp is lit when the heating element is switched on.

7. An apparatus according to claim 1; wherein each of said plurality of first switches is arranged to be actuated by the respective food-warmer plate when said plate is fully inserted in said slot.

8. An apparatus according to claim 7; wherein each one of said temperature sensors comprises a movable heat transfer body to which the respective thermostatic switch is attached, said body actuated by the respective plate upon full insertion of the plate in the slot, said respective first switch comprising a pair of contacts of the thermostatic switch and movable therewith, and a pair of fixed contacts.

9. An apparatus according claim 8; wherein a first pilot lamp is associates with each said heating element, and a second pilot lamp is lit when both the respective first switch is closed and at the same time the resespective thermostatic switch is open.

10. An apparatus according to claim 8; wherein locking means are mounted in the housing for each of the food-warmer plates, so as to lock the plate in a fully inserted position.

* * * * *